US006270159B1

(12) United States Patent
Johnston

(10) Patent No.: US 6,270,159 B1
(45) **Date of Patent: *Aug. 7, 2001**

(54) MANUAL UPLIFT APPARATUS

(76) Inventor: Gary L. Johnston, P.O. Box 183, Cowarts, AL (US) 36321

( * ) Notice: Subject to any disclaimer, the term of this patent is extended or adjusted under 35 U.S.C. 154(b) by 0 days.

This patent is subject to a terminal disclaimer.

(21) Appl. No.: 09/174,835

(22) Filed: Oct. 19, 1998

Related U.S. Application Data

(63) Continuation-in-part of application No. 08/941,557, filed on Sep. 30, 1997, now Pat. No. 5,876,095, which is a continuation-in-part of application No. 08/739,184, filed on Oct. 30, 1996, now abandoned, and a continuation-in-part of application No. 08/659,509, filed on Jun. 6, 1996, now Pat. No. 5,833,315, said application No. 08/739,184, filed on Oct. 30, 1996, now abandoned, is a continuation-in-part of application No. 08/659,509, and a continuation of application No. 08/456,176, filed on May 31, 1995, now abandoned, said application No. 08/659,509, is a continuation-in-part of application No. 08/456,176, filed on May 31, 1995, now abandoned, which is a continuation of application No. 08/226,353, filed on Apr. 12, 1994, now Pat. No. 5,468,049, and a continuation of application No. 08/144,034, filed on Nov. 1, 1993, now Pat. No. 5,445,431, which is a continuation-in-part of application No. 07/759,233, filed on Sep. 13, 1991, now Pat. No. 5,303,982.

(51) Int. Cl.[7] ..... A47C 1/02
(52) U.S. Cl. ..... 297/339; 482/96; 482/130
(58) Field of Search ..... 297/338, 339, 297/337, DIG. 10, 411.3, 323; 4/560.1, 564.1, 565.1; 482/95, 96, 130, 142

(56) References Cited

U.S. PATENT DOCUMENTS 459,282 * 9/1891 Gollon .
2,788,527 * 4/1957 Steven .
2,850,075 * 9/1958 Wilson .
3,233,868 * 2/1966 Harvey et al. .
4,034,426 * 7/1977 Hardwick et al. .
4,888,833 * 12/1989 Garcia et al. .
4,907,303 * 3/1990 Baird .
4,929,022 * 5/1990 Geraci .
5,303,982 * 4/1994 Johnston .
5,445,431 * 8/1995 Johnston .
5,468,049 * 11/1995 Johnston .

* cited by examiner

*Primary Examiner*—Laurie K. Cranmer

(57) ABSTRACT

A manual uplift apparatus comprising a structural frame unit, a mechanical uplift assembly unit, and a power translating mechanism connecting the two units to allow the user to more easily obtain a standing position from a previously seated position. A second use for the apparatus may be as an exercise product for exercising upper body muscle groups. The structural frame unit is used to support and guide the mechanical uplift assembly unit. The mechanical uplift assembly unit has two sections that can independently move vertically with respect to the structural frame unit. One section has a seat, the other has rails or hand engagement handles. When downward force is applied to the hand engagement handles, the section having the handles move vertically downward and produces an upward force in the section having the seat through the power translating mechanism. This interface allows the user to more easily uplift themselves from a seated position and is especially useful for older and/or medically disabled persons. Having the downward movement of the seat produce upward movement of the hand engagement handles allows the device to be utilized as an exercise product.

13 Claims, 8 Drawing Sheets

FIGURE 4C
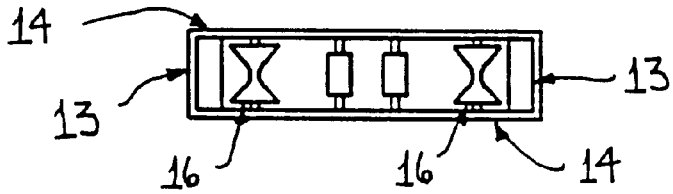
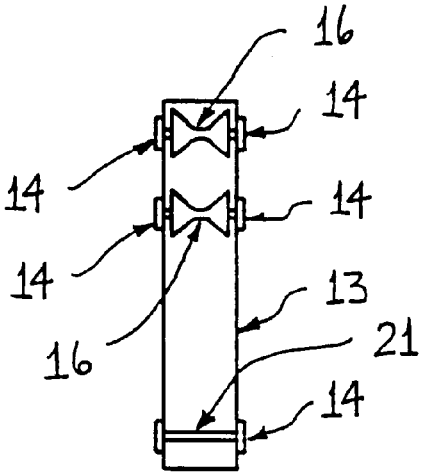
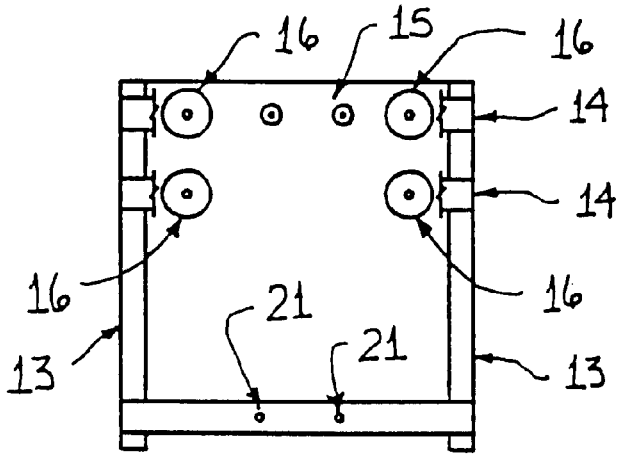
FIGURE 4B FIGURE 4A

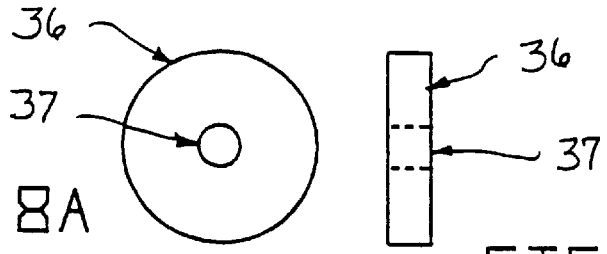
FIGURE 8A
FIGURE 8B
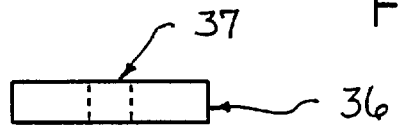
FIGURE 8C
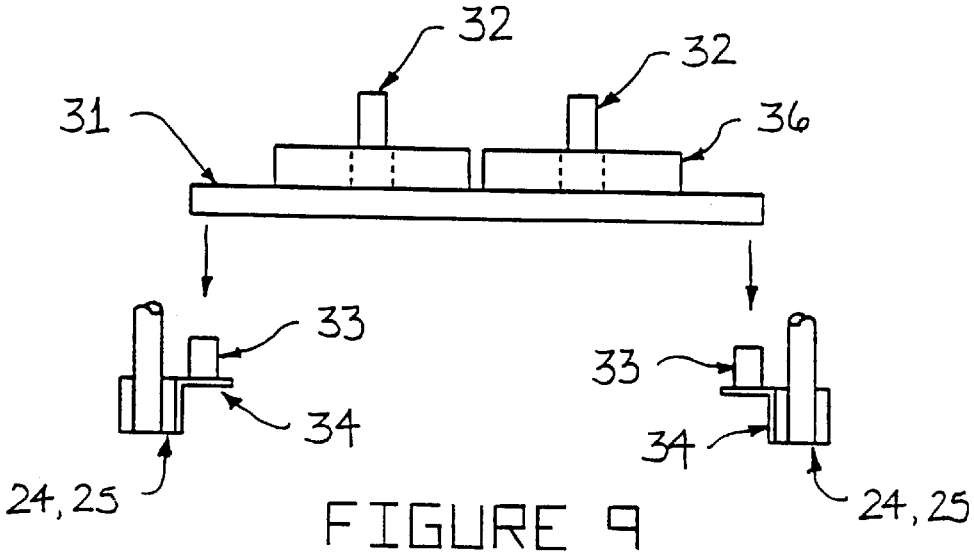
FIGURE 9

MANUAL UPLIFT APPARATUS

CROSS-REFERENCE TO RELATED APPLICATIONS

This application is a Continuation-In-Part of U.S. patent application Ser. No. 08/941,557, filed Sep. 30, 1997 now U.S. Pat. No. 5,876,095. U.S. patent application Ser. No. 08/941,557 is itself a Continuation-In-Part of U.S. patent application Ser. No. 08/659,509, filed Jun. 6, 1996, now U.S. Pat. No. 5,833,315 and a Continuation-In-Part of U.S. patent application Ser. No. 08/739,184, filed Oct. 30, 1996, now abandoned. U.S. patent application Ser. No. 08/739,184 is itself a Continuation-In-Part of U.S. patent application Ser. No. 08/659,509, filed Jun. 6, 1996, and a Continuation of U.S. patent application Ser. No. 08/456,176, filed May 31, 1995, now abandoned. U.S. patent application Ser. No. 08/659,509 is itself a Continuation-In-Part of U.S. patent application Ser. No. 08/456,176, filed May 31, 1995.

U.S. patent application Ser. No. 08/456,176 is a Continuation of U.S. patent application Ser. No. 08/226,353, filed Apr. 12, 1994, now U.S. Pat. No. 5,468,049, and a Continuation of U.S. patent application Ser. No. 08/144,034, filed Nov. 1, 1993, now U.S. Pat. No. 5,445,431, which are Continuations-In-Part of U.S. patent application Ser. No. 07/759,233, filed Sep. 13, 1991, now U.S Pat. No. 5,303,982.

BACKGROUND OF THE INVENTION

1. Field of the Invention

The present invention relates to a manual uplift apparatus. More particularly, the present invention relates to a sitting device from which the user may manually uplift themselves from a seated position to a point where a standing position may be more easily obtained. The device may also be used as an exercise device for upper body workouts.

2. Description of the Prior Art

Sitting devices designed to assist the user in obtaining a standing position from a previous seated position are known in the art. Conventionally, these sitting devices are relatively expensive, bulky, and weighty, making them difficult to move from place to place. Further, many of these devices use electrical power to uplift the user, therefore requiring proximity to electrical outlets, or the extra weight of batteries.

U.S. Pat. No. 459,282 to Gollon discloses an exercise apparatus which has a frame unit, uplift assembly, vertical support members, structural pulleys, guide elements, a seat member, rail members, a cable member, and a back support. The arrangement and interaction of these elements and the resultant device is unrelated to the present invention.

U.S. Pat. No. 2,788,527 to Steven discloses a bathtub which can be electrically raised and lowered between two walls using rollers and attached mercerized canvas.

U.S. Pat. No. 2,850,075 to Wilson discloses an invalid chair including a vertically adjustable carriage assembly. This carriage assembly is raised and lowered between supports through the use of a sling, which can be lengthened or shortened using power means and a crank.

U.S. Pat. No. 4,034,426 to Hardwick et al. discloses a mechanical bathtub lift chair apparatus wherein the user rocks the chair to elevate the seat through a ratchet system.

U.S. Pat. No. 4,888,833 to Garcia et al. discloses a cart for positioning a body on a toilet, having hydraulic means for lifting and lowering a seating means.

U.S. Pat. No. 4,907,303 to Baird discloses an orthopedic chair with a spring-loaded pivoting seat.

U.S. Pat. No. 4,929,022 to Geraci discloses a chair, with a spring-loaded pivoting seat, having a lifting means comprised of handle bars and a foot operated lever member. U.K. Patent GB 1,435,559 discloses a chair including a motorized seat, which can be raised and lowered without tilting relative to the base.

Published U.K. Patent Application GB 2,183,150A discloses a chair including a seat which tilts forward when actuated by the user through pivotally attached tilting means.

None of the above inventions and patents, taken either singly or in combination, is seen to describe the instant invention as claimed.

SUMMARY OF THE INVENTION

The present invention comprises a manualal uplift apparatus which includes a sitting device from which the user is uplifted from a seated position by pushing downward upon a set of rails or hand engagement handles, producing downward motion of said rails or hand engagement handles. This downward motion creates upward motion in a seat support member, to achieve a raised position. This raised seat position allows the user to more easily achieve an upright standing position. Also, the design of the apparatus may be such that the downward movement of the seat produces upward movement in the hand engagement handles.

Accordingly it is a principal object of the invention to provide a mechanical user-powered seat uplift apparatus that may be easily operated by persons who normally have difficulty in standing from seated position. It is another object of the invention to provide an upper body workout routine, such that the device may be used as an exercise product.

These and other objects of the present invention will become readily apparent upon further review of the following specification and drawings.

BRIEF DESCRIPTION OF THE DRAWINGS

FIG. 4A is a side view of the structural frame unit of the manual uplift apparatus.

FIG. 4B is a front view of the structural frame unit of the manual uplift apparatus.

FIG. 4C is a top view of the structural frame unit of the mechanical uplift apparatus.

FIGS. 8A–8C are top, side, and front views respectively of a weight member which may be utilzed when the device is used as an exercise product.

FIG. 9 is a front view of the interface between the assembly structure, the attachment structure, and the seat or handle mechanism engagement means.

DETAILED DESCRIPTION OF THE PREFERRED EMBODIMENTS

Figure 1A:
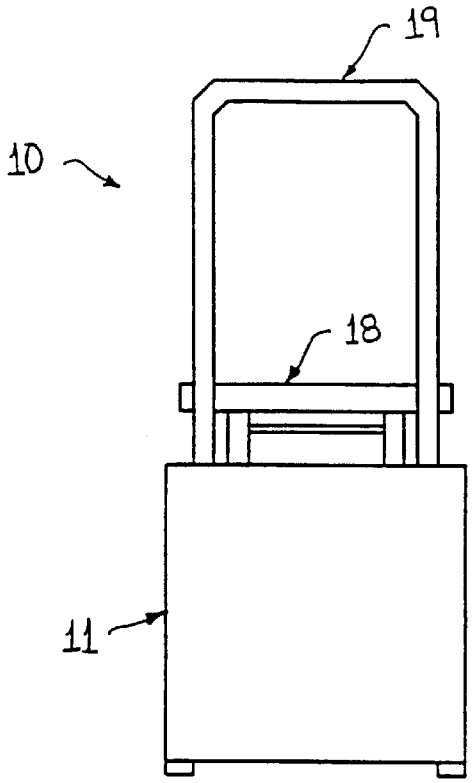
FIG. 1A is a side view of the manual uplift apparatus.

As can be seen by reference to the drawings, and in particular FIGS. 1A–4C, the manual uplift apparatus that forms the basis of the present invention is designated generally by the reference numeral 10, and comprises a structural frame unit, a mechanical uplift assembly unit, and a power translating mechanism.

The structural frame unit includes a frame 11, composed of vertical support members 13 and horizontal support members 14; mechanism engagement means 15 for engaging the power translating mechanism, and optionally guide elements 16.

The mechanical uplift assembly unit comprises a seat member 18 mounted to a first member 22, which supports the user while the user is trying to move from a substantially horizontal seated position to a raised position, and rails or hand engagement handles 19 disposed on each side of the seat mounted to a second member 23, wherein each member has a mechanism engagement means 24 and 25, respectively, for engaging the power translating mechanism 20, and is moveable in the substantially vertical direction independent of the other member, with respect to the structural frame unit. The mechanical uplift apparatus may optionally further comprise guide elements 16. Since each hand engagement handle 19 operates independent of each other, the user could utilize only one hand engagement handle to uplift themselves, but it will probably prove best to utilize two.

The power translating mechanism 20 operatively connects said first member, said second member, and said frame through their respective mechanism engagement means such that the downward force on said rails or hand engagement handles translates to upward force on said seat member.

The frame of the structural frame unit comprises vertical support members 13 and horizontal support members 14. Said vertical support members and said horizontal support members together form a rigid structure. This may be accomplished by any appropriate arrangement such as a unitary construction, jointed construction between said horizontal support members and said vertical support members, or braced construction between said horizontal support members and said vertical support members.

The mechanism engagement means 15 of the structural frame unit may be grooves, sleeves, brackets, pins, or hooks therein. Alternatively, the mechanism engagement means is attached to the frame and may further incorporate separately moveable parts, such as pulleys, wheels, gears, glides, grips, and rollers. Preferred mechanism engagement means of the structural frame unit include pins, sleeves, pulleys, or holes. For example, in FIGS. 5A and 5B, the structural frame unit comprises vertical support members 13 attached to two horizontal support members 14 of the frame 11. Therein the mechanism engagement means 15 are rollers mounted to vertical support members 13.

The optional guide elements 16 of the structural frame unit may also be a structural feature of said frame 11 or, alternatively, are attached to said frame and may optionally further comprise rollers or a low friction coating. These guide elements receive vertical support elements of the mechanical uplift unit. Preferred guide elements are grooved rollers. For example, in FIGS. 5A and 5B, the vertical support elements are round tubing which move within the circular grooves of the rollers. The rollers guide the vertical support elements in the substantially horizontal direction, most of the time rolling simultaneously with the movement of the vertical support elements.

Said seat member 18 is mounted to a first member 22, which comprises at least one substantially vertical support element of substantially constant horizontal dimension, and means for supporting said seat member. Said means for supporting said seat member are any appropriate means which fixedly attach seat member 18 to said first member 22, including adhesive, brackets and screws, or the like. Preferably said first member comprises two or more vertical support elements. The vertical support elements and the means for supporting said seat support member are arranged by any appropriate manner, such as unitary construction, jointed construction, or the like, such that the first member is substantially rigid. The first member comprises a mechanism engagement means 24, which may be of the same type used in the structural frame unit, may be a structural feature of said first member, or may be separately attached.

Rails or hand engagement handles 19 are disclosed on each side of said seat which are mounted to a second member 23, wherein said second member comprises at least one substantially vertical support element of substantially constant horizontal dimension. The second member comprises a mechanism engagement means 25, which may be of the same type used in the structural frame unit, may be a structural feature of said second member, or may be separately attached.

Figure 5A:
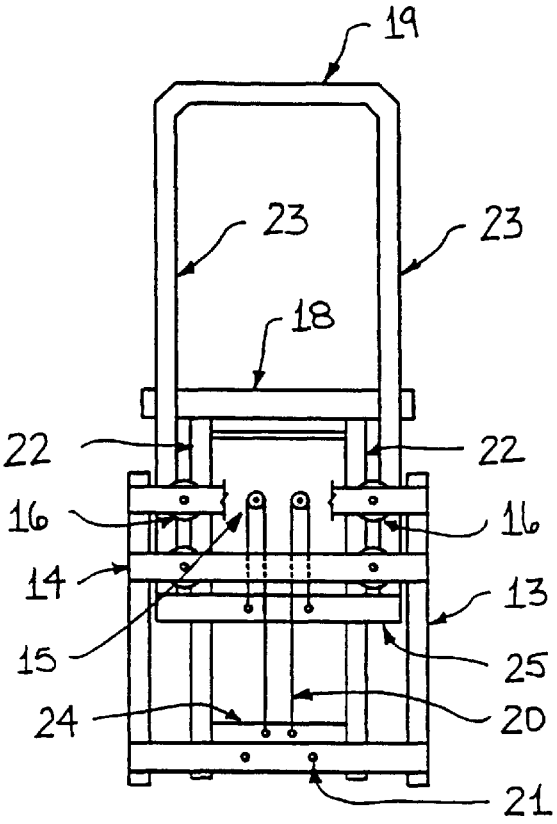
FIG. 5A is a side view of the mechanical uplift apparatus, before being engaged by the user.
Figure 5B:
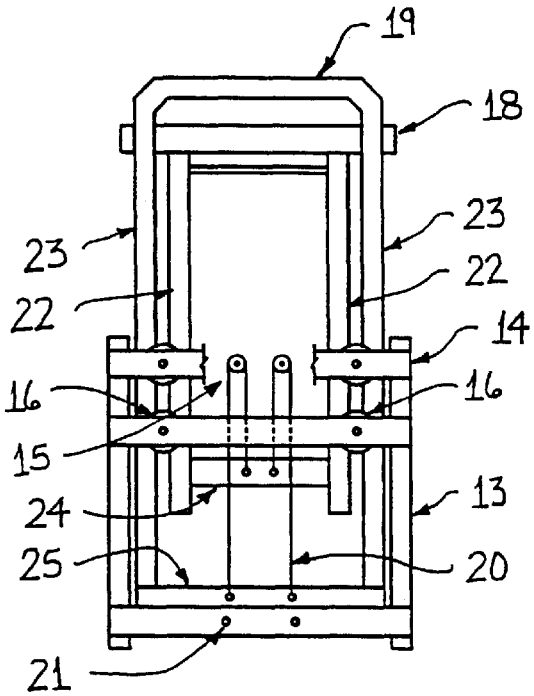
FIG. 5B is a side view of the mechanical uplift apparatus, after being engaged by the user.
Figure 6C:
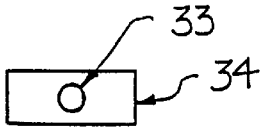
FIG. 6C is a top view of the the attachment structure of the weight assembly which is used when the apparatus is used as an exercise device.
Figure 6A:
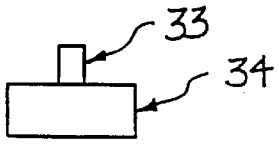
FIG. 6A is a side view of the the attachment structure of the weight assembly which may be used when the apparatus is used as an exercise device.
Figure 6B:
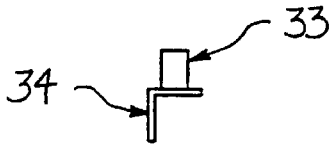
FIG. 6B is a front view of the the attachment structure of the weight assembly which is used when the apparatus is used as an exercise device.
Figure 7C:
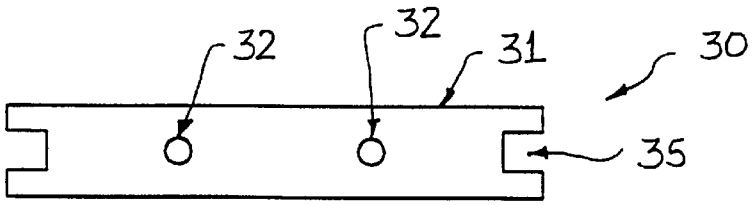
FIG. 7C is a top view of the the assembly structure of the weight assembly which is used when the apparatus is used as an exercise device.
Figure 7A:
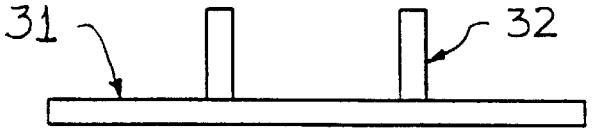
FIG. 7A is a side view of the the assembly structure of the weight assembly which is used when the apparatus is used as an exercise device.
Figure 7B:
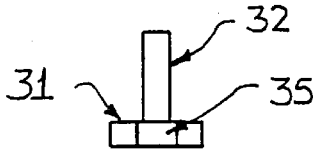
FIG. 7B is a front view of the the assembly structure of the weight assembly which is used when the apparatus is used as an exercise device.

The power translating mechanism 20 operatively connects said first member, said second member, and said frame through their respective mechanism engagement means such that the downward force on said rails or hand engagement handles 19 translates to upward force on said seat member 18. This may be accomplished through various power transfer schemes. Preferably, the power transfer mechanism comprises a linkage system utilizing a belt or tether. As shown in FIGS. 5A–5B, said belt or tether 20 operatively connects: the first member 22 through mechanism engagement means 24, the second member 23 through mechanism engagement means 25, and the frame 11 through rollers or pulleys 15. Different configurations may be used to produce different ratios of first member travel and second member travel, in the vertical direction. The invention has the advantage of utilizing other embodiments of power transfer mechanisms and mechanism engagement means that are available in the art, so long as the transfer of downward motion in the second member is translated to the upward motion of the first member.

It is desirable that the seat member 18, which is attached to said first member 22, maintains a substantially horizontal position throughout said upward motion of said first member. This may be accomplished by having the frame and first member sized so that movement of said first member is restricted to the vertical direction, being confined by the frame.

With reference to the drawings, FIGS. 5A and 5B demonstrate the operation of the apparatus. As seen, the first member 22 and the second member 23 are guided in a substantially vertical direction by guide elements 16. Guide elements 16 are grooved rollers, which roll when in contact with any part of the first and second member, although some sliding will also occurr. These not only guide the first and second member, but also make movement much smoother.

The user will push downward upon hand engagement handle 19, causing the hand engagement handle 19, along with the second member 23, to move downward. A power translating mechanism 20, which is simply a belt or tether, operatively connects the mechanism engagement means of the frame, first member, and second member. Gravity will also play a part in moving the seat upward. As the user pushes down upon the handles, and the body of the user is moved upward, the body weight of the user will also exert a downward force upon the handles.

The belt is secured at one end to the second member by mechanism engagement means 25. The belt then extends upward and over one of the rollers or pulleys, which are part of the mechanism engagement means 15 for the frame. The belt then extends downward and is secured to mechanism engagement means 24 for the first member 22. Preferably, there are two belts or tethers, and rollers and pulleys, per each side of the apparatus, so that the apparatus would not be disabled if one of the belts or tethers were to break. Therefore, the configuration of the belt is such that downward motion in the hand engagement handle 19 will produce upward motion in seat member 18, and vice versa.

As previously stated, the apparatus may also take on the form of an exercise product. A user lifting themselves upward and downward by pushing upon a set of handles simulates an upper body workout routine commonly known as "dips". This exercise routine is very beneficial for any active person, but should also prove extremely beneficial for elderly and/or disabled persons. The exercise routine is performed while in a seated position, and those muscle groups exercises are those which a person uses to exit a chair.

An optional item which allows better use of the apparatus as an exercise product is a weight assembly. The weight assembly may selectively be attached to either the seat or the hand engagement handle, so that the net weight of the seat, as felt by the user, may be increased or decreased. Attaching the weight assembly to the seat increases the net weight of the seat, while attaching the weight assembly to the hand engagement handle decreases the net weight of the seat.

The weight assembly 30 may be seen in FIGS. 6A–7C and FIG. 9. It is composed of an assembly structure 31 having upwardly extending post members 32, and attachment structure 33 having an upwardly extending post member 34. Multiple attachment members 33 are secured to the seat mechanism engagement means 24 and the handle mechanism engagement means 25, through some common means such as a bolt or weld. Assembly structure 31 has openings at each side, through which attachment post member 34 of attachment structure 33 may fit. This secures the assembly structure 31 to the attachment structure 33. The assembly structure 31 and attachment structure 33 may also be secured together through aanother type of securing means, such as a nut and bolt. The assembly structure may thus be attached to either the seat or the hand engagement handle.

FIGS. 8 and 9 demonstrate how a commonly known type of weight member 36 may be mounted on the assembly structure 31 to add weight to either the seat or the hand engagement handle. Weight member 36 has a center opening 37, through which assembly post member 32 of assembly structure 31 may fit. Assembly post member 32 thus secures weight member 36 to assembly structure 31.

Figure 10A:
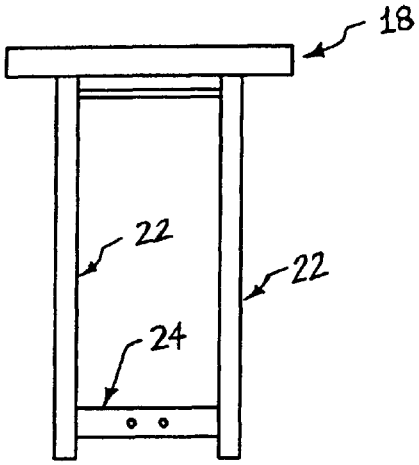
FIG. 10A is a side view of the seat member of the mechanical uplift assembly unit having a cross support means.
Figure 10B:
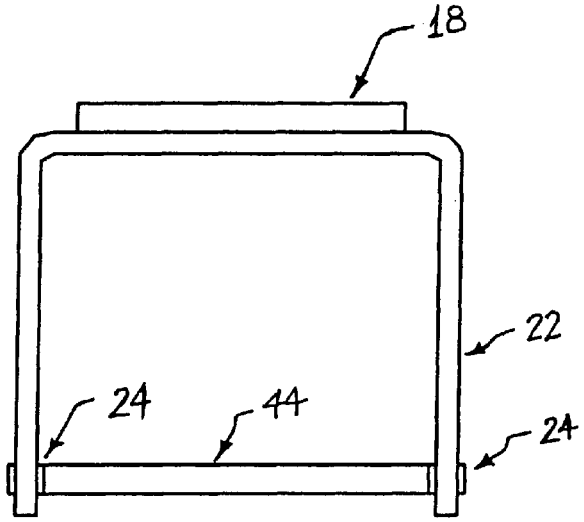
FIG. 10B is a front view of the seat member of the mechanical uplift assembly unit having a cross support means.
Figure 10C:
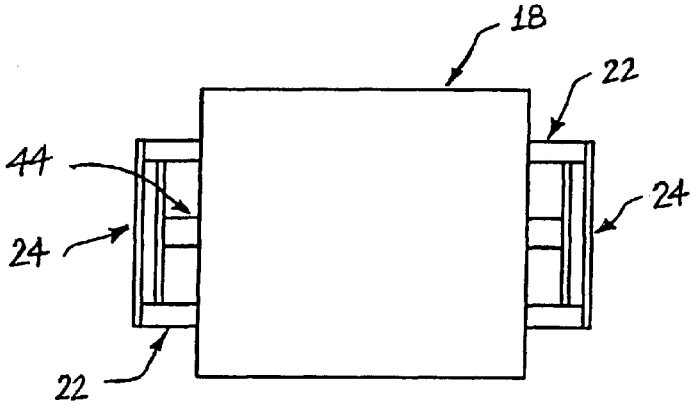
FIG. 10C is a top view of the seat member of the mechanical uplift assembly unit, having a cross support means.

FIGS. 10A, 10B, and 10C demonstrate the seat member 18 having at least one first member 22 mounted to the left of the seat member, and at least one first member 22 mounted to its right, and a cross connection means 44 connecting the right and left first members. As shown in the figures, it is preferable to have two first members 22 on each side of the seat, with a seat mechanism engagement means 24 connecting the same side first members 22. It is also preferable to have the cross connection means 44 connect the mechanism engagement means 24 on the right side to the mechanism engagement means 24 on the left side. This provides for a more sturdy structure, which makes movement of the seat member 18 in the upward and downward directions much easier.

Figure 1B:
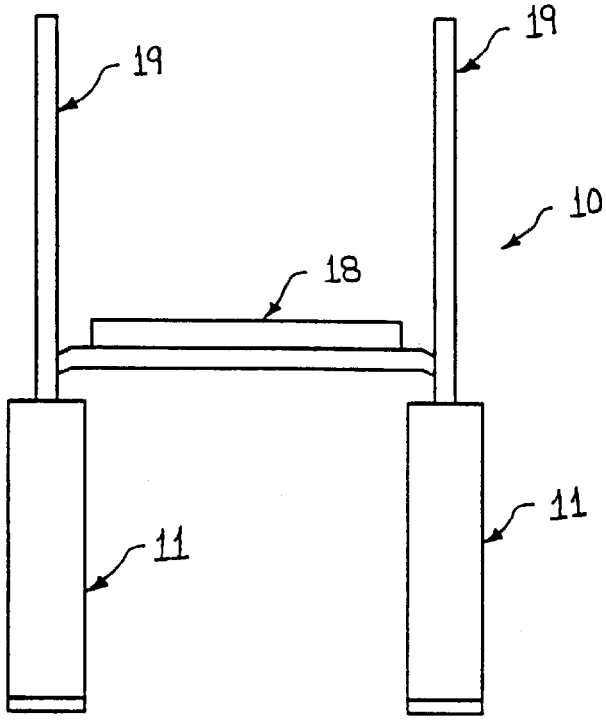
FIG. 1B is a front view of the manual uplift apparatus.
Figure 1C:
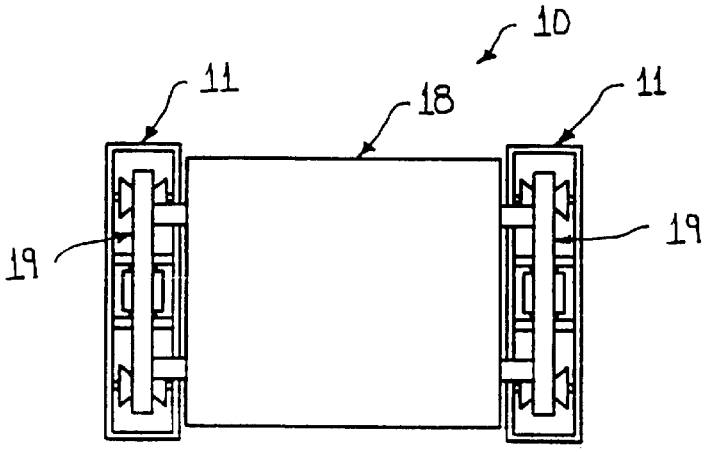
FIG. 1C is a top view of the manual uplift apparatus.
Figure 2C:
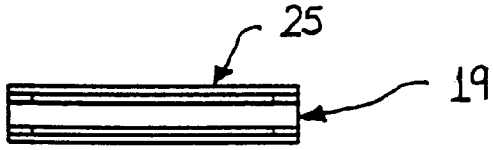
FIG. 2C is a top view of the hand engagement handle of the mechanical uplift assembly unit.
Figure 2A:
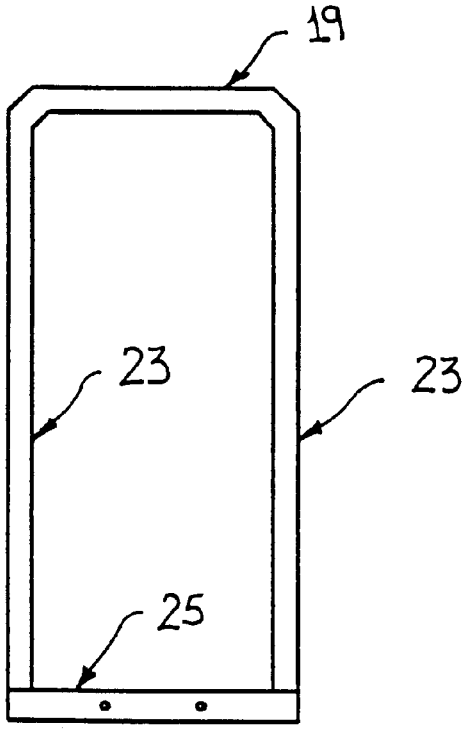
FIG. 2A is a side view of the hand engagement handle of the mechanical uplift assembly unit.
Figure 2B:
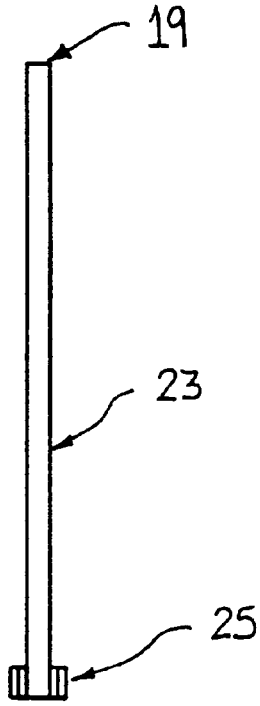
FIG. 2B is a front view of the hand engagement handle of the mechanical uplift assembly unit.
Figure 3A:
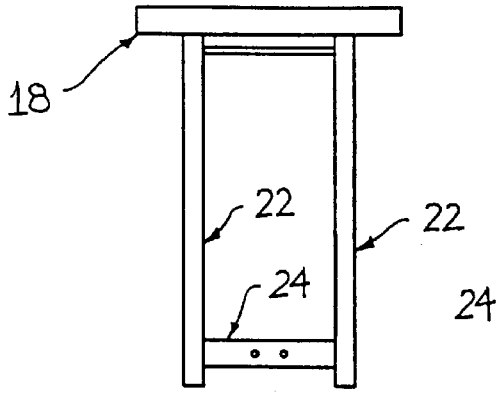
FIG. 3A is a side view of the seat member of the mechanical uplift assembly unit.
Figure 3B:
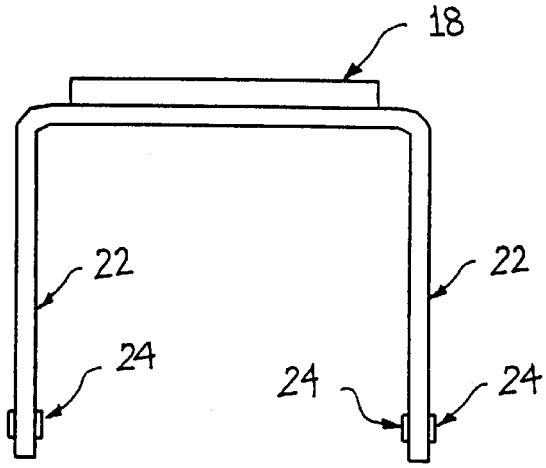
FIG. 3B is a front view of the seat member of the mechanical uplift assembly unit.
Figure 3C:
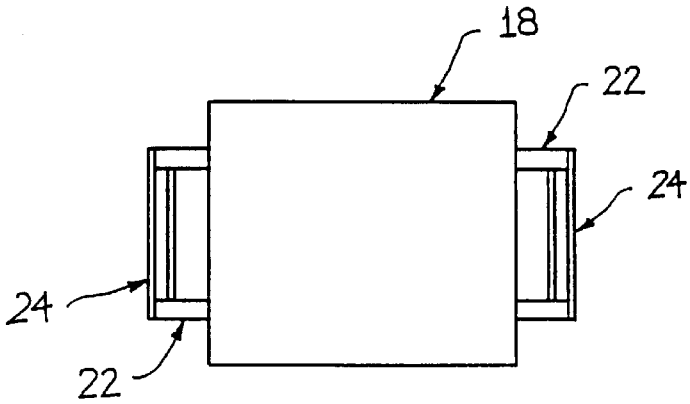
FIG. 3C is a top view of the seat member of the mechanical uplift assembly unit.

Similarly, it is preferable that the device have a right and left hand engagement handle, each with two associated second members, with the right second members being connected by a right handle mechanism engagement means, and the left second members being connected by a left handle mechanism engagement means. This is shown in FIGS. 1A, 1B, 1C. Also, it is possible to have a cross connection means connect the right and left handle mechanism engagement means. This makes the hand engagement handles a more sturdy, single structure, instead of two individual components. This would provide for a more evenly distribution of forces by the handles upon the right and left sides of the seat. However, the device will also perform its intended function very well with two separate hand engagment handles.

In the cases of both the seat member 18 and hand engagement handles 19, the respective cross connection means 44 may be connected to the respective mechanism engagement means in many different ways. These include bolts, screws, clamps, and welds.

It is understood that the present invention is not limited to the sole embodiment described above, but encompasses any and all embodiments within the scope of the following claims.

I claim:

1. A manual uplift apparatus comprising;

a frame having a right and left side;

a seat mounted to right and left first members; said first members having right and left seat mechanism engagement means respectively mounted thereon, each of said first members comprising at least one substantially vertical support element connected to and extending downward from said seat, such that said seat mechanism engagement means being moveable in an upward and downward direction with respect to said frame;

a means for rigidly connecting said right and left seat mechanism engagement means;

right and left hand engagement handles having right and left handle mechanism engagement means respectfully associated therewith for receiving a downward force from a user, said handle mechanism engagement means being moveable independently of said seat mechanism engagement means in the upward and downward directions with respect to said frame;

a right power transfer mechanism operatively connecting said right seat mechanism engagement means, said right handle mechanism engagement means, and said right side of said frame, a left power transfer mechanism operatively connecting said left seat mechanism engagement means, said left handle mechanism engagement means, and said left side of said frame, said right and left power transfer mechanisms used for translating the downward forces applied by the user upon said hand engagement handles into upward forces on the seat, whereby downward movement of said hand engagement handles produces upward movement of said seat.

2. The manual uplift apparatus according to claim 1, said right and left hand engagement handles being mounted to right and left second members, said right and left handle mechanism engagement means being mounted to said respective second members, said second members being used to incorporate said handle mechanism engagement means with said hand engagement handles.

3. The manual uplift apparatus according to claim 2, wherein said second members further comprise;

at least one substantially vertical support element connected to and extending downward from said hand engagement handle.

4. The manual uplift apparatus according to claim 3, said frame further comprising at least one guide member adapted to receive said second members and guide said second members in the upward and downward directions with respect to said frame, said guide member being used to couple said hand engagement handle to said frame.

5. The manual uplift apparatus according to claim 4, said guide member including a grooved roller turnably mounted on said frame, said grooved roller sized to contain and guide said second member as it moves along a portion of its groove.

6. The manual uplift apparatus according to claim 2, said frame further comprising at least one guide member adapted to receive said first member and guide said first member in the upward and downward directions with respect to said frame, said guide member being used to couple said seat to said frame.

7. The manual uplift apparatus according to claim 6, said guide member including a grooved roller turnably mounted on said frame, said grooved roller sized to contain and guide said first member as it moves along a portion of its groove.

8. The manual uplift apparatus according to claim 1, wherein said right power transfer mechanism is a tether, said right seat mechanism engagement means and said right handle mechanism engagement means engaging said tether, said right side of said frame having a right frame mechanism engagement means also engaging said tether, such that said tether operatively connects said right side of seat, said right hand engagement handle, and said right side of said frame, said left power transfer mechanism also being a tether, said left seat mechanism engagement means and said left handle mechanism engagement means engaging said tether, said left side of said frame having a left frame mechanism engagement means also engaging said tether, such that said tether operatively connects said left side of seat, said left hand engagement handle, and said left side of said frame.

9. The manual uplift apparatus according to claim 1, said apparatus further comprising a weight means selectively attachable between said seat and said hand engagement handles, such that the amount of force applied by the user upon said hand engagement handles which is required to move said seat in the upward direction may be selectively varied.

10. A manual uplift apparatus comprising;

a frame having grooved rollers mounted thereon;

a seat operatively engaging said grooved rollers of said frame, said seat having a seat mechanism engagement means asociated therewith, said seat being moveable in the upward and downward directions with respect to said frame;

at least one hand engagement handle for receiving a downward force from a user, said hand engagement handle operatively engaging said grooved rollers of said frame, said hand engagement handle having a handle mechanism engagement means associated therewith, said hand engagement handle being moveable independently of said seat in the upward and downward directions with respect to said frame;

a power transfer mechanism operatively connecting said seat, said hand engagement handle, and said frame, for translating the downward force applied by the user upon said hand engagement handle into an upward force upon said seat, whereby downward movement of said hand engagement handles produce upward movment of said seat.

11. The manual uplift apparatus according to claim 10, said seat being mounted to a first member, wherein said first member comprises at least one substantially vertical support element connected to and extending downward from said seat, said seat mechanism engagement means being mounted to said first member, said first member being used to operatively engage said grooved rollers of said frame means.

12. The manual uplift apparatus according to claim 11, said hand engagement handle being mounted to a second member, wherein said second member comprises at least one substantially vertical support element connected to and extending downward from said hand engagement handle, said handle mechansism engagement means being mounted to said second member, said second member being used to operatively engage said grooved rollers of said frame means.

13. The manual uplift apparatus according to claim 10, said frame having a frame mechanism engagement means, wherein said power transfer mechanism is a tether, said seat mechanism engagement means, said handle mechanism engagement means, and said frame mechanism engagement means engaging said tether, such that said tether operatively connects said seat, said hand engagement handle, and said frame.

* * * * *